United States Patent [19]

Kun

[11] Patent Number: 4,978,278

[45] Date of Patent: Dec. 18, 1990

[54] TURBOMACHINE WITH SEAL FLUID RECOVERY CHANNEL

[75] Inventor: Leslie C. Kun, Grand Island, N.Y.

[73] Assignee: Union Carbide Corporation, Danbury, Conn.

[21] Appl. No.: 378,904

[22] Filed: Jul. 12, 1989

[51] Int. Cl.[5] ..... F01D 13/02

[52] U.S. Cl. ..... 415/144; 415/168.2; 415/172.1; 415/177; 277/53; 277/15; 62/113; 62/513

[58] Field of Search ..... 415/168.2, 168.1, 170.1, 415/172.1, 171.1, 173.5, 177, 144; 277/53, 67, 15; 62/113, 513, 87

[56] References Cited

U.S. PATENT DOCUMENTS

| | | | |
|---|---|---|---|
| 2,529,880 | 11/1950 | McClure | 62/123 |
| 3,250,069 | 5/1966 | Rhoda | 415/169.1 |
| 4,132,416 | 1/1979 | Adams, Jr. | 277/18 |
| 4,286,919 | 9/1981 | Yamaguchi | 415/168.2 |
| 4,472,107 | 9/1984 | Chang et al. | 415/172.1 |
| 4,478,497 | 10/1988 | Hanson et al. | 68/38 |
| 4,542,586 | 10/1985 | von Pragenau | 415/172.1 |
| 4,721,313 | 1/1988 | Pennink | 277/53 |

FOREIGN PATENT DOCUMENTS

| | | | |
|---|---|---|---|
| 855251 | 5/1940 | France | 415/177 |
| 1059878 | 3/1954 | France | 415/177 |
| 10709 | 1/1984 | Japan | 415/177 |

*Primary Examiner*—John T. Kwon

*Attorney, Agent, or Firm*—Stanley Ktorides

[57] ABSTRACT

Turbomachine and method of operation wherein shroud seal fluid is channelled from the turbomachine at or proximate to the seal and preferably recycled back to the turbomachine.

19 Claims, 3 Drawing Sheets

TURBOMACHINE WITH SEAL FLUID RECOVERY CHANNEL

TECHNICAL FIELD

This invention relates generally to the field of turbomachines, such as centrifugal compressors, pumps, and radial inward flow turbines, having shrouded impellers and seals between the impeller shroud and a stationary housing.

BACKGROUND ART

Shrouded impellers are used routinely in certain turbomachines such as centrifugal pumps, compressors, and in high efficiency turbines, such as, for example, in turboexpanders used to produce refrigeration by expansion of the process gas in cryogenic gas separation, refrigeration or liquefaction cycles. Since the fluid pressure is higher at the outer diameter of the impeller as compared to the pressure at the inner diameter of the impeller at the impeller eye, a non-contacting seal, such as a labyrinth seal, is customarily used to reduce the bypass or recirculation of the working fluid lost between the stationary walls of the turbomachine housing and the impeller shroud. This bypass or recirculation fluid loss is wasteful and an attempt is usually made to minimize this loss by designing tighter fitting seals with an increased number of sealing lips. Unfortunately, this approach is limited by two effects. First, tight and long seals tend to impose a cross coupling force on the bearings resulting in a destabilizing effect and, second, the friction forces will increase in a tight and long seal to a value where they could overwhelm the recirculation or bypass losses.

Whether the machine is a turbine or a compressor handling gaseous compressible fluid, or a pump handling liquid, the pressure at the outer diameter of the impeller is greater than that at the inner diameter. Thus, the higher pressure at the impeller outer diameter will cause part of the working fluid to bypass the wheel in case of the turbine or set up a recirculation flow in the case of a compressor or pump. It can be appreciated that this bypass or recirculation flow represents an undesirable parasitic loss.

Generally, there are three loss mechanisms involved. The first, in the case of turbines, is due to the fact that the portion of working fluid which bypasses the wheel does not perform external work but rather undergoes a Joule-Thomson expansion. Contrary to this lack of external work for a turbine, in a compressor or pump, external work has to be performed repeatedly on the recirculating portion of the working fluid.

Another type of loss mechanism generated by the bypass or recirculation flow is due to the aerodynamic behavior of the flow in diffusers. Whether the turbomachine is a turbine, compressor or pump, the fluid will have the lowest static pressure at or around the impeller inner diameter. Thus, part of the fluid velocity head will be converted with a certain efficiency to pressure downstream of the impeller eye. Injecting the bypass or recirculation flow at the inlet end of the impeller is deleterious due to increasing the thickness of the boundary layer. This reduces the efficiency of the pressure recovery by causing the boundary layer to separate from the turbomachine walls. Even when it is carefully optimized by use of efficient seals, the recirculation or bypass fluid flow is on the order of one percent of the working fluid flow. While this may not appear to be excessive, unfortunately this fluid is injected into the main flow at a very unfavorable location i.e. at a point after which deceleration of the main flow relative to the surrounding walls occurs.

The third loss mechanism is due to the fact that the temperature of the bypassed or recirculating fluid is higher than that of the turbine outlet or compressor and pump inlet at the impeller inner diameter. Therefore, the compressor or pump will have to work against a higher average temperature resulting in yet higher work input. In the case of a cryogenic turbine operating for example in a liquefaction cycle, the heat will be added at a low temperature point of the cycle and subsequently must be heat pumped and discharged at ambient temperature level.

Accordingly it is an object of this invention to provide an improved turbomachine wherein the inefficiency caused by the flow of recirculation or bypass fluid is reduced.

It is another object of this invention to provide an improved method for operating a turbomachine wherein the inefficiency caused by the flow of recirculation or bypass fluid is reduced.

SUMMARY OF THE INVENTION

The above and other objects which will become apparent to one skilled in the art upon a reading of this disclosure are attained by the present invention one aspect of which is:

Turbomachine comprising:

(A) an impeller mounted on a shaft extending from an outer to an inner diameter and having a plurality of blades mounted thereon;

(B) a shroud covering the blades to form fluid flow channels from the outer to the inner diameter;

(C) a stationary housing spaced from the shroud;

(D) a seal between the shroud and the stationary housing; and (E) channel means communicating with the space between the shroud and the housing at or proximate to the seal, and extending to the outside of the housing.

Another aspect of this invention is:

A method for operating a turbomachine having a rotating assembly spaced from a stationary housing and a seal within said space, and wherein fluid flows from a higher pressure side toward a lower pressure side of the turbomachine within said space, comprising passing fluid from said space, at or proximate to the seal, to the outside of the housing.

DETAILED DESCRIPTION

The invention will be described in detail with reference to the Drawings.

Figure 1:
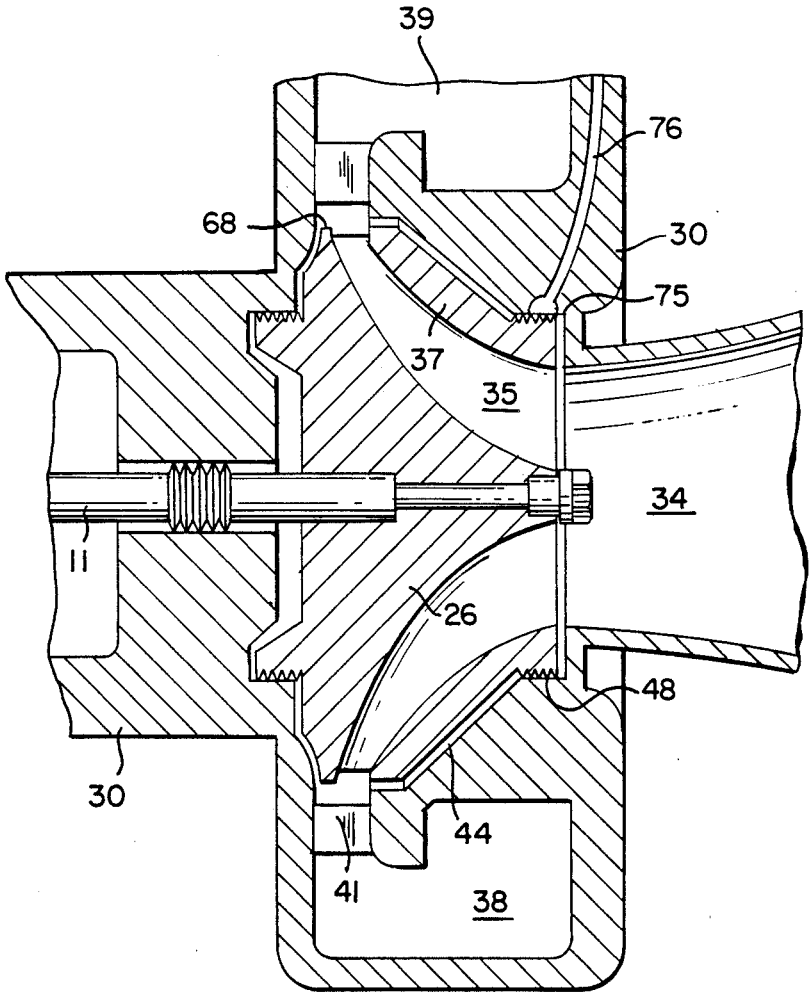
FIG. 1 is a cross-sectional representation of one embodiment of the turbomachine of this invention.

FIG. 1 is a cross-sectional view of a portion of a compressor of this invention. Referring to FIG. 1, impeller 26 is mounted on shaft 11 and extends from an outer diameter 68 to an inner diameter 75. A plurality of blades 35 are mounted on the impeller and a shroud 37 covers the blades so as to form a fluid flow channel between each pair of blades extending between the inner and the outer diameter. The shaft, impeller, blades and shroud form the rotating assembly of the turbomachine. The rotating assembly is spaced from a stationary housing 30. In addition to a compressor, the turbomachine of this invention may also be, for example, a turbine or a pump. The working fluid may be either gas or liquid.

Referring back to the compressor illustrated in FIG. 1, fluid, such as gas, is passed from inlet 34 through the fluid flow channels between blades 35 from the inner to the outer diameter. As the fluid passes through the fluid flow channels, it is pressurized and is discharged as higher pressure fluid through diffuser 41, volute 38 and diffuser discharge 39.

As mentioned previously the rotating assembly is necessarily spaced from the stationary housing. This spacing between shroud 37 and housing 30 is shown as space 44. Pressurized fluid from the higher pressure side of the turbomachine tends to flow toward the lower pressure side at the inner diameter. This sets up an inefficiency because some portion of the pressurized fluid is passed back into the lower pressure fluid and thus is compressed again. In order to reduce this inefficiency, a seal is generally placed within the space between the shroud and the stationary housing. The seal may be any effective seal. The most commonly used seal is a labyrinth seal. The seal may be at the inner diameter of the impeller, such as labyrinth seal 48 illustrated in FIG. 1, or may be at an increased diameter.

If the turbomachine were a turbine the working fluid flow would be in the opposite direction, i.e., from the outer diameter of the impeller, through the fluid flow channels between the blades, to the eye. In the case of a turbine, fluid would not recirculate through the space between the impeller shroud and the stationary housing as in the case of pumps or compressors, but, rather, fluid would bypass the fluid flow channels and thus the expansion of this bypass fluid would not produce useful recoverable work.

As discussed previously, the seal does not completely stop the flow of recirculation or bypass fluid. While the amount of fluid which passes through the seal is small, this fluid has a deleterious effect, as was previously discussed, because it passes into the lower pressure fluid at the inner diameter of the impeller.

The turbomachine and method of this invention essentially eliminates this deleterious effect and, moreover, enables the effective use of the recirculation or bypass fluid. Referring back to FIG. 1, channel 76 communicates with space 44 at or proximate seal 48 and extends to the outside of housing 30, preferably away from the lower pressure side of the turbomachine. Channel 76 is preferably a two part channel comprising a ringlike or annular collector around the shroud and a conduit extending from the annular collector to the outside of the housing. Seal gas is collected around the entire impeller by the annular collector and then the collected gas is carried to the outside of the housing by one or more conduit-like members within the housing. Preferably 80 to 100 percent of the fluid flowing from the higher pressure side through space 44, most preferably from 90 to 100 percent, flows through channel 76 to the outside of the housing. Generally, the intent is to capture the majority of the seal flow between the high and low pressure and divert it to the channel. For some situations seal flow can occur from each end of the seal. For these cases, added flow of from 1 to 5 percent of the seal gas flow can flow from the low pressure side of the seal to the channel.

In a particularly preferred embodiment of this invention, thermal insulation is provided to at least some of the surface of the shroud and/or housing forming space 44. This reduces the heat exchange between the main fluid stream and the fluid in space 44. The insulation can be any effective insulation such as a suitable polymer coating, as for example, a tetrafluoroethylene polymer, or ceramic insulation.

Figure 2:
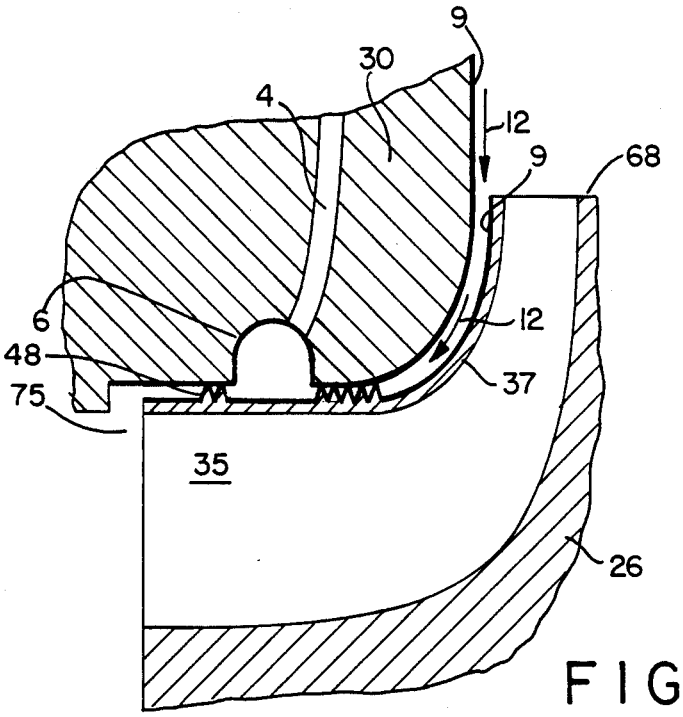
FIG. 2 is a more detailed cross-sectional representation of the seal and channel of this invention.

FIG. 2 illustrates a more detailed view of the seal channel of this invention. Referring now to FIG. 2, impeller 26, shroud 37 and blades 35 form the turbomachine fluid flow channels. Shroud 37 is spaced from stationary housing 7 and bypass or recirculation fluid passes through the spacing from the higher pressure at outer diameter 68 toward the lower pressure at inner diameter 11 as depicted by arrows 12. The opposing surfaces of shroud 37 and housing 30 are covered by thermal insulation layers 9.

Figure 4:
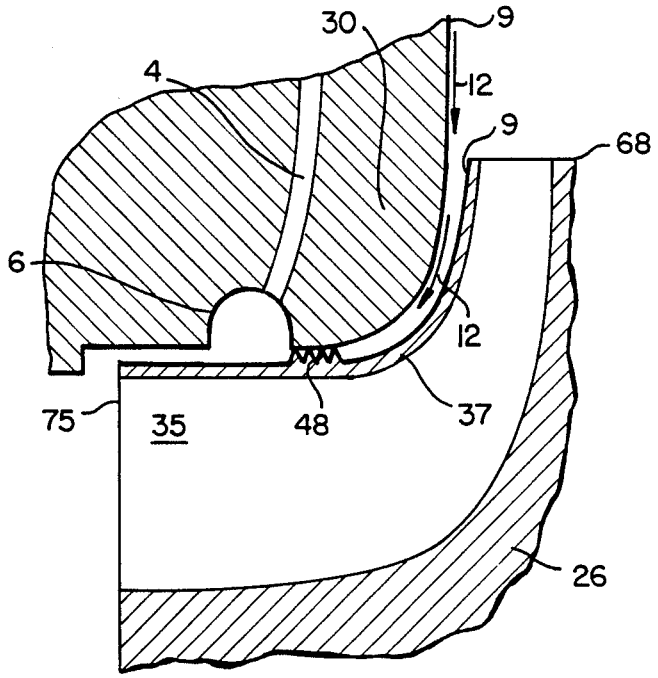
FIG. 4 is a cross-sectional representation of another embodiment of the seal and channel of this invention wherein the channel communicates between the inner diameter and the seal.

Labyrinth seal 5 is spaced from the inner diameter intermediate the inner and the outer diameter of the shrouded impeller assembly. The seal channel comprising annular member 6 and conduit member 4 communicates with the space between the seal and the housing at or proximate to seal 48. The point of communication of the annular member 6 could be completely on the lower pressure side of the seal as illustrated in FIG. 4. Preferably the point of communication, as illustrated in FIG. 2, is at the seal but at least 50 percent of the distance from the seal edge closest to the outer diameter, i e., at least 50 percent of the distance from the higher pressure side of the seal. Most preferably the point of communication is at the seal within 80 to 95 percent of the distance from the higher pressure side of the seal or from the seal edge closest the outside diameter.

Figure 3:
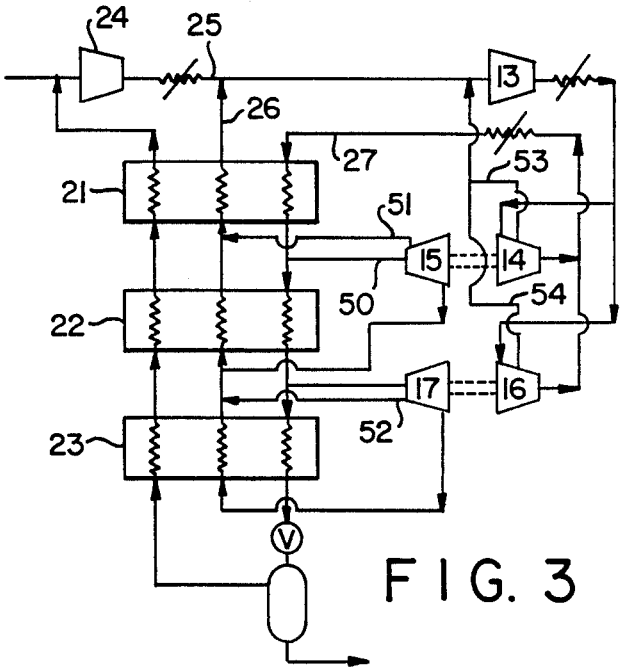
FIG. 3 is a schematic representation of a liquefaction cycle using the turbomachine and method of this invention.

Most preferably the recirculation or bypass fluid removed from the turbomachine through the seal channel is returned back to the cycle in which the turbomachine is employed. FIG. 3 illustrates one such method. FIG. 3 depicts a state-of-the art nitrogen liquefaction cycle. Other even more advanced liquefaction cycles are disclosed and claimed in U.S. Pat. No. 4,778,497-Hanson et al.

Referring now to FIG. 3, feed compressor 24 compresses feed and low pressure recycle nitrogen to an intermediate pressure and then this stream 25, joined by stream 26 returning from the heat exchangers is further compressed by recycle compressor 13 and by the booster compressors 14 and 16. The high pressure stream 27 is then cooled to an intermediate temperature and one part 50 is expanded in turbine 15 and joined with stream 26 at a lower than inlet temperature. Turbine 15 utilizes the developed shaft work to drive compressor 14. The installation of turbine 17 in its relation to the cycle is the same as for turbine 15, except turbine 17 is operating at a lower temperature level and it drives booster compressor 16. The turbine and cycle losses are minimized if the recovered bypass stream 51 from turbine 15, is channeled to stream 26, between heat exchangers 21 and 22. Similarly, the recovered bypass stream 52 from turbine 17 may be channeled to stream 26 between heat exchangers 23 and 22. The recovered recirculation streams 53 and 54 from compressors 14 and 16 respectively can be returned to the suction of compressor 13. In this way the recirculation and bypass fluids recovered from the turbomachines through the seal channels are put back into the fluid processing cycle at points having comparable pressure and temperature characteristics.

Although the turbomachine and operating method of this invention have been described in detail with reference to certain embodiments, those skilled in the art will recognize that there are other embodiments of the invention within the scope and spirit of the claims.

I claim:

1. Turbomachine comprising:

(A) an impeller mounted on a shaft extending radially inward from an outer to an inner diameter and having a plurality of blades mounted thereon;

(B) a shroud covering the blades to form fluid flow channels from the outer to the inner diameter;

(C) a stationary housing spaced from the shroud;

(D) a seal between the shroud and the stationary housing;

(E) channel means communicating with a space between the shroud and the housing adjacent to the tooth portion of to the seal, and extending to the outside of the housing;

(F) means to recycle fluid from the output of the turbo machine to the input of the turbomachine, said cycle means including means to raise the temperature of the output fluid; and (G) means to pass fluid from the channel means to the recycle means downstream of said temperature raising means.

2. The turbomachine of claim 1 wherein the turbomachinery is a compressor.

3. The turbomachine of claim 1 wherein the turbomachinery is a turbine.

4. The turbomachine of claim 1 wherein the turbomachinery is a pump.

5. The turbomachine of claim 1 wherein the seal is a labyrinth seal.

6. The turbomachine of claim 1 wherein the seal is mounted on the inner diameter of the impeller.

7. The turbomachine of claim 6 wherein the channel means communicates with said space between the inner diameter and the seal.

8. The turbomachine of claim 1 wherein the channel means communicates with said space at the seal.

9. The turbomachine of claim 8 wherein the channel means communicates with said space at least 50 percent of the distance from the seal edge closest the outer diameter.

10. The turbomachine of claim 1 further comprising insulation on at least some of one or both of the spaced surfaces of the shroud and the housing.

11. The turbomachine of claim 1 wherein the channel means comprises an annular member around the shroud communicating with the space, and a conduit member extending from the annular member to the outside of the housing.

12. A method for operating a turbomachine having a rotating assembly spaced from a stationary housing and a seal within said space, and wherein fluid flows from a higher pressure side toward a lower pressure side of the turbomachine within said space, comprising passing bypass fluid from said space adjacent to the tooth portion of the seal, to the outside of the housing, recycling fluid from the output of the turbomachine to the input of the turbomachine, raising the temperature of the recycling fluid, and passing bypass fluid into the recycling fluid after the temperature of the recycling fluid has been raised.

13. The method of claim 12 wherein the fluid is a gas.

14. The method of claim 12 wherein the fluid is a liquid.

15. The method of claim 12 wherein the fluid is passed from said space downstream of the seal.

16. The method of claim 12 wherein the fluid is passed from said space at the seal.

17. The method of claim 16 wherein the fluid is passed from said space at least 50 percent of the distance from the higher pressure side of the seal.

18. The method of claim 12 wherein the fluid passed from said space comprises 80 to 100 percent of the fluid flowing from the higher pressure toward the lower pressure side within said space.

19. The method of claim 12 wherein the fluid passed from said space comprises 90 to 100 percent of the fluid flowing from the higher pressure toward the lower pressure side within said space.

* * * * *